United States Patent [19]

Takamatsu

[11] 3,977,051

[45] Aug. 31, 1976

[54] REUSABLE SLIDE FASTENER WITH EMERGENCY OPENING MEANS

[75] Inventor: Ikuo Takamatsu, Uozu, Japan

[73] Assignee: Yoshida Kogyo Kabushiki Kaisha, Japan

[22] Filed: Oct. 16, 1975

[21] Appl. No.: 623,261

[30] Foreign Application Priority Data

Oct. 22, 1975 Japan ..... 49-121743

[52] U.S. Cl. ..... 24/205 R; 24/205.11 R

[51] Int. Cl.[2] ..... A44B 19/00; A44B 19/38

[58] Field of Search ..... 24/205 R

[56] References Cited

UNITED STATES PATENTS 3,122,808 3/1964 Maschi ..... 24/205 R

FOREIGN PATENTS OR APPLICATIONS 558,341 6/1958 Canada ..... 24/205 R

*Primary Examiner*—Bernard A. Gelak

*Attorney, Agent, or Firm*—Bucknam and Archer

[57] ABSTRACT

A slide fastener having an emergency opening zone at its intermediate point from which the fastener can be forced open in an emergency without pulling a slider along interengaged rows of fastener elements. To make this slide fastener reusable, a slider escape mechanism is arranged at its top end for causing the slider to ride on only one of the stringers by releasing the other stringer therefrom after the fastener has been forced open. Arranged at the bottom end of the fastener is a connect-disconnect terminal mechanism which may take the form of a box-and-pin separable coupling, such that the fastener stringer can be reconnected to permit normal slider movement after having been completely separated from each other.

1 Claim, 4 Drawing Figures

REUSABLE SLIDE FASTENER WITH EMERGENCY OPENING MEANS

BACKGROUND OF THE INVENTION

This invention relates generally to slide fasteners, and in particular to a slide fastener having emergency opening means such that the fastener is normally opened or closed by a slider moving along interlockable rows of fastener elements or scoops but, in an emergency, can be forced open from its midpoint without manipulating the slider. The slide fastener of this character finds the most advantageous use on entrances of camping tents and like closure openings of other articles.

The slide fastener of the type under consideration, as heretofore constructed, typically comprises an emergency opening zone disposed in a suitable position intermediate both ends of interengageable rows of fastener elements, and top and bottom stop assemblies to limit the movement of a slider along the fastener elements. When the fastener is forced open from the emergency opening zone in an emergency such as a fire or earthquake, the slider is located in its fully closed position on the rows of fastener elements, where the slider is in contact with the top stop assembly. If this slider could be smoothly pulled down to the bottom stop assembly along the rows of fastener elements, the slide fastener would be reusable because then it can be opened and closed by the slider in the usual manner.

In reality, however, the rows of fastener elements are thoroughly disengaged from each other after the slide fastener has been forced open in an emergency, so that the slider can hardly be pulled down therealong to its lowermost position. If the slider is somehow managed to move down along the disengaged rows of fastener elements, its movement will be completely blocked as it approaches the bottom stop assembly, since then the element row portions lying between the slider and bottom stop assembly will bulge so as to form an elliptical spacing therebetween.

As the slider cannot be pulled down to its endmost position after the emergency opening of the fastener, it is impossible to open and close the fastener throughout its length. The forced downward movement of the slider is also easy to cause irregularities in the pitch of the fastener elements or the dislodgement of the elements. For these reasons the slide fastener that has been forced open in an emergency has heretofore been considered not restorable to its normal use.

SUMMARY OF THE INVENTION

It is an object of this invention to provide a slide fastener which can be readily forced open in an emergency without manipulating a slider and which, after having been forced open, can be restored to an operable state through a simple procedure.

Briefly, the invention is directed to a slide fastener having an emergency opening zone which is located intermediate both ends of interengageable rows of fastener elements and from which the fastener can be forced open in an emergency. The invention comprises a slider escape mechanism arranged at one end of the slide fastener to cause a slider to ride onto only one of the fastener stringers by releasing the other stringer therefrom after the fastener has been forced open, and a connect-disconnect terminal mechanism such as a box-and-pin separable coupling arranged at the other end of the fastener.

After the slide fastener has been forced open from the emergency opening zone in an emergency, its stringers are temporarily completely separated from each other, with the slider riding on one of the stringers at one end thereof. The slider is then pulled down to the other end of the stringer along the row of fastener elements carried thereby, and the two stringers are reconnected by the connect-disconnect terminal mechanism at the said other end of the fastener. The slider is now movable along the rows of fastener elements to engage or disengage the same in the usual manner.

It should be appreciated that no undue stress is exerted on the fastener elements during the foregoing process of fastener restoration. The slide fastener according to the invention thus lends itself to continued use in good working order.

The features which are considered characteristic of this invention are set forth in particular in the appended claim. The invention itself, however, both as to its organization and mode of use, together with additional objects and advantages thereof, will become apparent from the following description read in connection with the accompanying drawings in which like reference characters refer to like parts throughout.

DESCRIPTION OF THE PREFERRED EMBODIMENT

Figure 1:
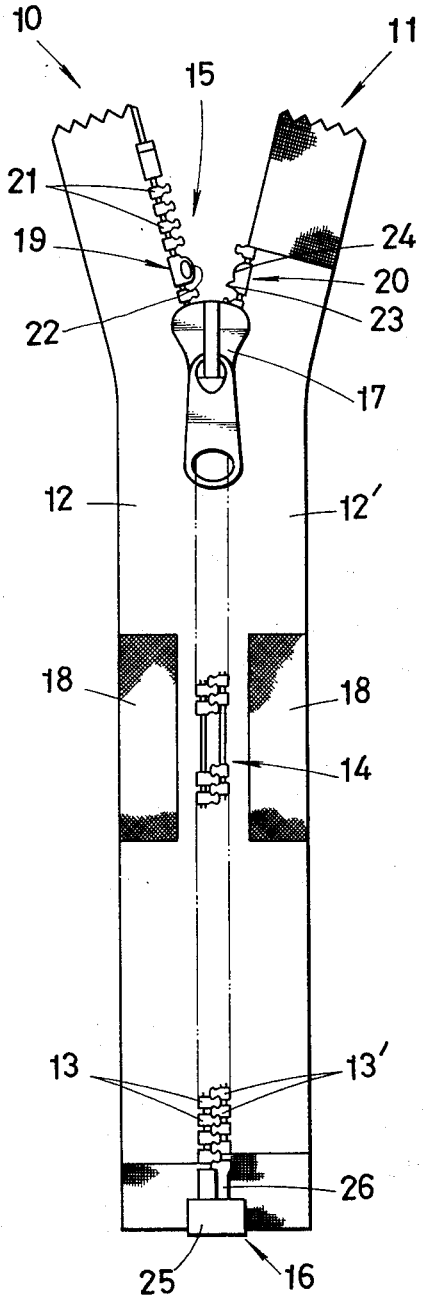
FIG. 1 is a plan view of a slide fastener incorporating the novel concepts of this invention, the slide fastener being shown closed.

With particular reference to FIG. 1 the invention is therein shown embodied in a slide fastener having a pair of completely separable fastener stringers 10 and 11 which include tapes 12 and 12' along the opposed inner edges of which there are arranged interengageable rows of fastener elements or scoops 13 and 13' of the well known discrete type. The illustrated slide fastener broadly comprises an emergency opening zone 14 located intermediate both ends of the rows of fastener elements 13 and 13', a slider escape mechanism 15 arranged at or adjacent one end of the slide fastener, and a connect-disconnect terminal mechanism 16 at the other end of the fastener.

The emergency opening zone 14 is such that the rows of fastener elements 13 and 13' are made incapable of interlocking engagement in that zone when the fastener is closed by a slider 17 movable therealong. In this particular embodiment of the invention the emergency opening zone 14 is formed by removing several fastener elements from each stringer tape. Alternatively, the emergency opening zone may be formed by completely or partly removing the coupling heads of the several fastener elements on each stringer tape so that these elements may be essentially incapable of interengagement when the fastener is closed.

If desired, a pair of reinforcements 18 of suitably rigid material may be fixedly arranged along, and on the opposite sides of, the emergency opening zone 14.

These reinforcements should be longer than the emergency opening zone and extend beyond both extremities of the zone. In this manner the slide fastener will not open accidentally from the zone in spite of a transverse pull which may be exerted on the stringer tapes 12 and 12' in the normal use of the fastener.

The slider escape mechanism 15 is designed to permit the slider 17 to escape from the interengageable rows of fastener elements 13 and 13' and to ride on only the stringer 10 after the slide fastener has been forced open in an emergency. To this end the slider escape mechanism comprises a pair of yieldable stops 19 and 20 mounted on the respective rows of fastener elements 13 and 13', and an extra length of fastener elements 21 carried by the stringer 10 as an upward extension of the elements 13.

Normally, the yieldable stops 19 and 20 should function to limit the upward or fastener closing movement of the slider 17 along the rows of fastener elements 13 and 13'. When the slider 17 in its fully closed position is further forcibly pulled upwardly, however, the yieldable stops 19 and 20 should cooperate to permit the slider to travel therepast and to ride onto the extra length of fastener elements 21 on the stringer 10.

In this particular embodiment the stop 19 is shown to have a resilient wall portion 22, whereas the other stop 20 is shown to have a projection 23 for abutting contact with the lower edge of the stop 19 and a convexity 24 to be pressed against the resilient wall portion 22 of the stop 19. Thus, when the slider 17 is moved upwardly along the rows of fastener elements 13 and 13' to its fully closed position thereon in the normal use of the fastener, the projection 23 of the stop 20 will abut against the lower edge of the stop 19 to limit the fastener closing movement of the slider.

If then the slider 17 is further forcibly pulled upwardly, the resilient wall portion 22 of the stop 19 will deform under pressure from the convexity 24 of the stop 20 within the body of the slider. The slider 17 will thus travel past the pair of yieldable stops 19 and 20 and ride onto the extra length of fastener elements 21 on the stringer 10, as then the other stringer 11 is released from the slider.

The connect-disconnect terminal mechanism 16 at the other or bottom end of the slide fastener is designed to connect and disconnect the pair of stringers 10 and 11 as required while the rows of fastener elements 13 and 13' are disengaged from each other. In one form of construction this mechanism 16 takes the form of the known box-and-pin separable coupling which comprises a box component 25 and pin component 26, as illustrated in FIG. 1.

Figure 2:
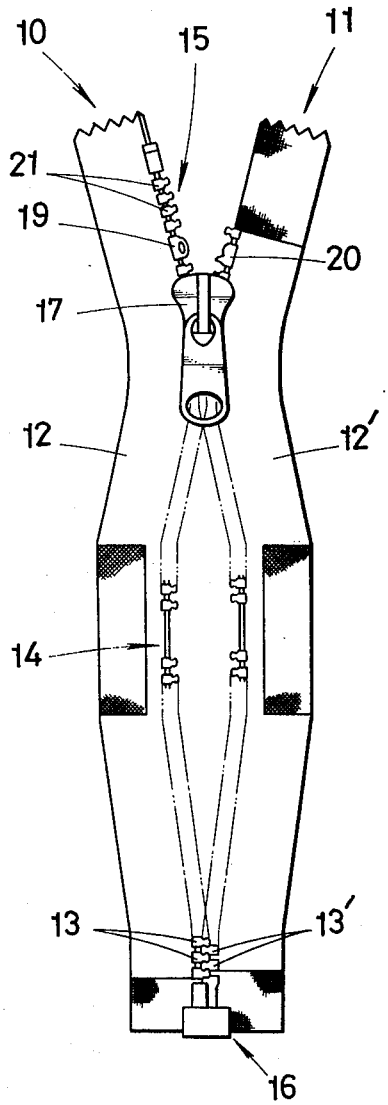
FIG. 2 is a similar view showing the slide fastener forced open in an emergency.
Figure 3:
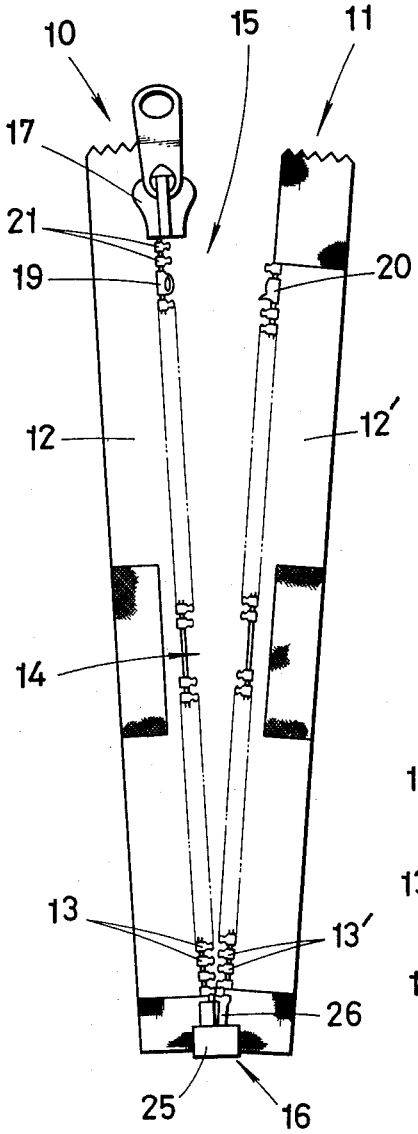
FIG. 3 is also a similar view showing the slide fastener with its slider guided onto one of the fastener stringers after the emergency opening of the fastener.

The mode of use of the slide fastener of the foregoing construction will now be described with reference to FIGS. 2, 3 and 4. In order to open the fastener in the event of a fire or other emergencies, a pressure may be applied to its emergency opening zone 14 so as to cause partial disengagement of the fastener elements 13 and 13' adjacent the zone. By then spreading the stringers 10 and 11 apart from each other, the fastener can be opened without pulling the slider along the rows of fastener elements, as will be seen from FIG. 2.

The slide fastener which has been thus forced open in an emergency can be restored to its normal operable state by the following procedure. With reference to FIG. 3 the slider 17 is first forcibly pulled upwardly past the pair of yieldable stops 19 and 20 and is thus caused to escape from the interengageable rows of fastener elements 13 and 13' and to ride onto the extra length of fastener elements 21 on the stringer 10.

The rows of fastener elements 13 and 13' may then be completely disengaged at their lower portion, if necessary, and the pin component 26 of the connect-disconnect terminal mechanism 16 may be pulled out of the box component 25. The stringers 10 and 11 are now completely separated from each other.

Figure 4:
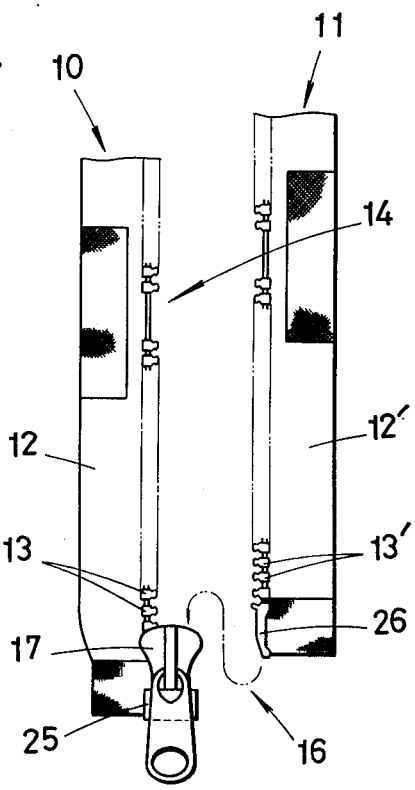
FIG. 4 is a fragmentary plan view explanatory of the way the two fastener stringers are reconnected after having been temporarily separated from each other.

Succeedingly, as illustrated in FIG. 4, the slider 17 may be pulled down from the extra length of fastener elements 21 along the row of elements 13 into abutting contact with the box component 25. The pin component 26 can now be inserted into the box component 25 through the slider 17 to reconnect the pair of stringers 10 and 11 at their bottom ends. The slide fastener will be closed in the normal manner as the slider 17 is then pulled upwardly along the interengageable rows of fastener elements 13 and 13'.

It is believed that the advantages and improved results of the slide fastener according to the invention are apparent from the foregoing detailed description. It is understood, however, that the invention itself is not to be restricted by the exact details of the slide fastener disclosed herein, as many modifications will readily occur to those skilled in the art without departing from the spirit or scope of the invention as expressed in the following claim.

What is claimed is:

1. In a slide fastener which includes a pair of stringers having interengageable rows of fastener elements carried thereby, said rows of fastener elements having an emergency opening zone which is located intermediate both ends thereof and which is adapted to permit the slide fastener to be forced open in emergencies without pulling a slider along the rows of fastener elements, the combination thereof with a slider escape mechanism at one end of the slide fastener for causing the slider to ride on only one of the stringers by releasing the other stringer after the slide fastener has been forced open from the emergency opening zone, and a connect-disconnect terminal mechanism at the other end of the slide fastener for connecting and disconnecting the stringers while the rows of fastener elements are disengaged from each other.

* * * * *